US006929063B2

(12) United States Patent
Reese et al.

(10) Patent No.: US 6,929,063 B2
(45) Date of Patent: Aug. 16, 2005

(54) CUTTING LOCATOR TOOL

(75) Inventors: James Warren Reese, Spring, TX (US); David Cundiff, Kingwood, TX (US); Wilfred Schexnayder, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/288,032

(22) Filed: Nov. 5, 2002

(65) Prior Publication Data

US 2004/0084185 A1 May 6, 2004

(51) Int. Cl.[7] ..... E21B 29/08
(52) U.S. Cl. ..... 166/2
(58) Field of Search ..... 166/298, 55.7, 166/376

(56) References Cited

U.S. PATENT DOCUMENTS

| | | | | |
|---|---|---|---|---|
| 2,746,550 | A | | 5/1956 | Mitchell |
| 3,957,115 | A | | 5/1976 | Kerzee et al. |
| 4,403,657 | A | | 9/1983 | Adams |
| 5,054,555 | A | | 10/1991 | Lalande |
| 5,191,936 | A | | 3/1993 | Edwards |
| 5,435,394 | A | | 7/1995 | Robertson |
| 5,636,692 | A | | 6/1997 | Haugen |
| 5,791,417 | A | | 8/1998 | Haugen et al. |
| 5,810,083 | A | * | 9/1998 | Kilgore ..... 166/120 |
| 5,924,489 | A | | 7/1999 | Hatcher |
| 6,186,226 | B1 | | 2/2001 | Robertson |
| 6,333,700 | B1 | | 12/2001 | Adnan |
| 6,568,480 | B2 | * | 5/2003 | Dewey ..... 166/382 |
| 2002/0144817 | A1 | * | 10/2002 | Doane et al. ..... 166/298 |
| 2003/0234104 | A1 | * | 12/2003 | Johnston et al. ..... 166/298 |

* cited by examiner

*Primary Examiner*—William Neuder
(74) *Attorney, Agent, or Firm*—Timothy M. Donoughue; Darryl M. Springs; Keith R. Derrington

(57) ABSTRACT

Disclosed herein is a locator system for a cutting device in combination with a production string. Where the production string has at least one detent along its circumference. The invention also comprises a lock formed to engage the detent, a cutting device, and a body on which the lock is attached. The body is connected to the cutting device such that when the lock is engaged to the detent, the cutting device is operatively connected to the detent and the cutting device is positioned at a location to accurately sever the production string at a desired depth. An alternative embodiment of the detent is a nipple profile and the production string comprises a series of tubing members connected end to end. The tubing members can be a completion tool, tubing, or a combination of both. Also disclosed is a method of using the locator system.

18 Claims, 3 Drawing Sheets

CUTTING LOCATOR TOOL

BACKGROUND OF THE INVENTION

1. Field of the Invention

The invention relates generally to the field of oil and gas well operations. More specifically, the present invention relates to a method and apparatus to facilitate severing sections of wellbore tubing.

2. Description of Related Art

Generally, a hydrocarbon producing wellbore consists of metal casing cemented into the surrounding formation and a production string that is inserted within the casing. The production string consists primarily of annular tubing and other completion members such as packers connected end to end to form a single annular member. The tubing, in combination with the packers, forms a conduit from the inside the wellbore through which oil and or gas is produced from the wellbore to the Earth's surface. Packers are employed inside of wellbores for various purposes, such as gravel packing, well control, well zone isolation, or to protect the casing.

Once placed inside of the wellbore, both the tubing and the packers are subject to mechanical failures. The tubing may begin leaking due to corrosion, material failure, or a faulty connection. One of the packers may develop a mechanical failure and no longer be able to provide its intended function. Depending on the severity of the failure, or the importance of the packer's function, it may be necessary to shut down the well and remove the damaged section of the production string for repair. Due to the structural configuration of the production string replacing and repairing the damaged section requires that the production string be severed below the damaged portion and that all of the production string above the damaged portion be removed from the wellbore.

The production string can be severed by use of a cutting device. Cutting devices can employ ballistics, torches, or extremely caustic chemical materials that radially emit a cutting medium and sever the production string at the desired location along its length. Because these incisions are often far below the Earth's surface, the ability to accurately position and stabilize these cutting devices from grade is very important. Accurate positioning of a cutting device is important to ensure that the proper section of the production string is removed from the wellbore. If the production string is severed well below the problem location, too much tubing or a functional packer may be inadvertently removed—which can be a loss of valuable equipment. Similarly, if the cut is errantly made above the problem location, an additional cut must be made to then remove the non-functioning portion of the production string to replace it with a properly functioning device. The added cutting step requires time and expense.

In some instances the thickness of the section to be severed is thicker than normal and more than one cutting sequence is required to completely sever the production string. Thus after the initial cut it would be required to raise the cutting tool from the wellbore, refurbish the cutting medium (i.e. chemical, pyrotechnics, fuel, etc.), and reinsert the cutting tool into the wellbore for additional cutting sequences until the production string is fully severed. Most cutting tools are suspended by wirelines, slicklines, or by some other line that is generally elastic and stretches during deployment. Because of the elastic lines combined with the weight of the cutting device, which can weigh in excess of 150 pounds, it can be difficult to position the cutting device to the exact depth of a previous cut.

Magnetic positioning devices that monitor thickness variations of the tubing string, such as collar locators, can be deployed along with the cutting tool to aid in positioning the cutting tool to the proper depth for cutting. However, the production string often comprises a multitude of packers whose thickness can vary along their lengths or vertical axis. This can produce confusing thickness measurements, which in turn makes positioning of the cutting device difficult and uncertain.

During the cutting process large forces are produced by the cutting medium (chemical, pyrotechnic, or flame) that are exerted onto the cutting device. The forces are so severe that they can cause the cutting device to move during the cutting process. This is highly undesired since movement of the cutting device during the cutting sequence will result in uneven jagged cuts, or in some cases may not result in a complete cut. To ensure that the cutting device is secured within the casing during the cutting process, numerous brakes or braces have been developed. One of the braking or bracing means developed involves placing an anchor at some predetermined point within the casing upon which the cutting tool or perforating device will rest. Another embodiment involves a series of fins that expand outward from the cutting device and engage the casing prior to initiating the cutting procedure to secure the tool to the casing during the cutting procedure. One device involves a pyrotechnic cutting tool that equalizes the gases exiting from the cutting device above and below the cutting flame exit point such that the pressure of the exiting gas will stabilize the tool within the casing. The equal pressures purports to preclude upward or downward movement of the cutting device during the cutting process. Yet another embodiment involves plugs having serrated surfaces that also extend outward from the cutting device to prevent axial movement during the cutting procedure. Examples of these devices can be found in U.S. Pat. No. 6,223,818 issued to Hrupp; U.S. Pat. No. 6,186,226, issued to Robertson; U.S. Pat. No. 5,435,394 issued to Robertson; and U.S. Pat. No. 4,598,769 issued to Robertson. However, each of these devices suffers from one or more of the following disadvantages.

One of the problems associated with the device disclosed in the above noted patents is it is difficult or impossible to position the cutting device at the precise depth within the wellbore to sever the production string at the desired location. These tools rely on some type of line to be deployed into a wellbore. As noted above, when the section of production string to be cut is far below the earth's surface, utilization of an elastic line introduces a potential for vast measurement error when positioning the cutting device prior to its cut. Further, although the above noted devices took advantage of frictional forces existing between the slips or serrated edges contacting the casing, these devices can still become dislodged during the cutting process. Therefore, there exists a need for a device useful for severing pipe within a wellbore, where the device can be precisely located within the wellbore for at least one cutting sequence; and during cutting the device remains secure within the casing.

BRIEF SUMMARY OF THE INVENTION

The present invention involves a locator system for a cutting device in combination with a production string, where the production string has at least one detent along its circumference. The invention also comprises a lock formed to engage the detent, a cutting device, and a body on which the lock is attached. The body is connected to the cutting device such that when the lock is engaged to the detent, the cutting device is operatively connected to the detent and the cutting device is positioned at a location to accurately sever the production string at a desired depth. An alternative embodiment of the detent is a nipple profile and the production string comprises a series of tubing members connected end to end. The tubing members can be a completion tool, tubing, or a combination of both. Also disclosed is a method of using the locator system. The completion tool can be a packer. The lock of the present invention can comprise at least one member disposed on the body configured to engage the detent. A spring urging the member into engaging contact with the detent can also be employed.

The member of the present invention is provided with an outer surface formed to fixedly mount upon the detent to support the placement system for a cutting device within the production string such that the cutting device is positioned at a location within the production string to accurately sever the production string at a desired depth. A further feature of the present invention involves a selective option that can be used when the production string has two or more detents. The selective option allows the user to position the cutting device at any of the detents present in the production string.

Also disclosed herein is a method of using the present invention comprising, forming at least one detent on a tubular member that is part of a production string, disposing the tubular member within a wellbore, and forming a lock on the cutting device to engage the detent. Before the cutting device is lowered into the wellbore, the location where it is desired to cut the tubular member is determined. This helps to determine which detent is to be engaged by the lock. The cutting device is then inserted within the wellbore to engage the lock with the detent. This positions the cutting device to cut the tubular member at the location where it is desired to cut the tubular member. After the cutting sequence is completed the cutting tool can then be removed from the wellbore. If needed, the cutting device can be reinserted into the wellbore, to the same exact location, and the cutting sequence repeated to ensure severance of the production string.

DETAILED DESCRIPTION OF THE INVENTION

Figure 1:
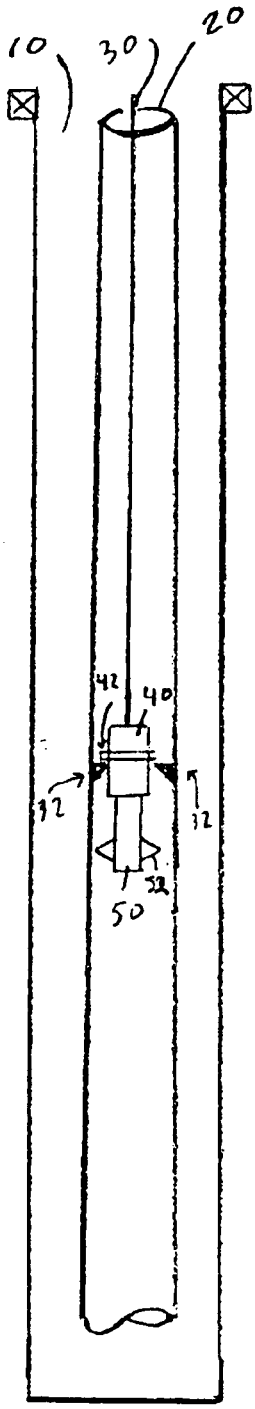
FIG. 1 depicts a partial cut away view of one embodiment of the present invention within a wellbore.

The present invention has use below the Earth's surface, therefore in describing the present invention, the terms "top" and "above" mean closer to the Earth's surface, whereas the terms "bottom" and "below" mean further from the Earth's surface. With reference to the drawing herein, a schematic representation of one embodiment of a cutting tool locator 40 disposed within a production string 20 is shown in FIG. 1. As is well known, the production string 20 can be comprised of tubing, a series of packers, other completion tools, or a combination of tubing, packers, and other completions tools.

A detent 32 is disposed on the inner circumference of the production string 20, and as such can be located on the tubing, packers, or other completion tools. The detent 32 comprises two or more protrusions formed on the inner wall of the production string 20 at the same elevation that extend away from the wall of the production string inward. For the purposes of illustration a single detent 32 is shown, however, in practice, two or more detents 32 can be employed along the production string 20. The detents 32 should be formed onto the production string 20 before it is lowered into the wellbore 10. The detents 32 can be welded onto the production string 20 or integrally formed when the particular piece of production string 20 is fabricated. It is preferred that the detent 32 be in the form of a nipple profile.

Based on knowledge and experience, a skilled artisan can predict the likely locations where the production string 20 could fail in the future. Knowing this, the production string 20 can be designed with detents 32 positioned at an elevation that enables the present invention to sever the production string 20 so that the damaged portion of the production string 20 can be removed and replaced. The position at the production string 20 where it is to be severed is the desired location. The calculation of the desired location can be done by those skilled in the art.

Formed on the outer radius of the cutting tool locator 40 is a locator shoulder 42 formed to contact and rest on the detents 32. Attached to the lower portion of the cutting tool locator 40 is a cutting tool 50. The type of cutting tool 50 employed is not critical to the present invention. However the cutting tool 50 should possess sufficient cutting ability to sever the production string at the location where it is positioned. As appreciated by one skilled in the art, the cutting tool 50 can cut the production string 20 with flames 52 from combustion within, by chemicals stored within, by pyrotechnics, mechanical devices, or any other suitable cutting method.

Figure 2:
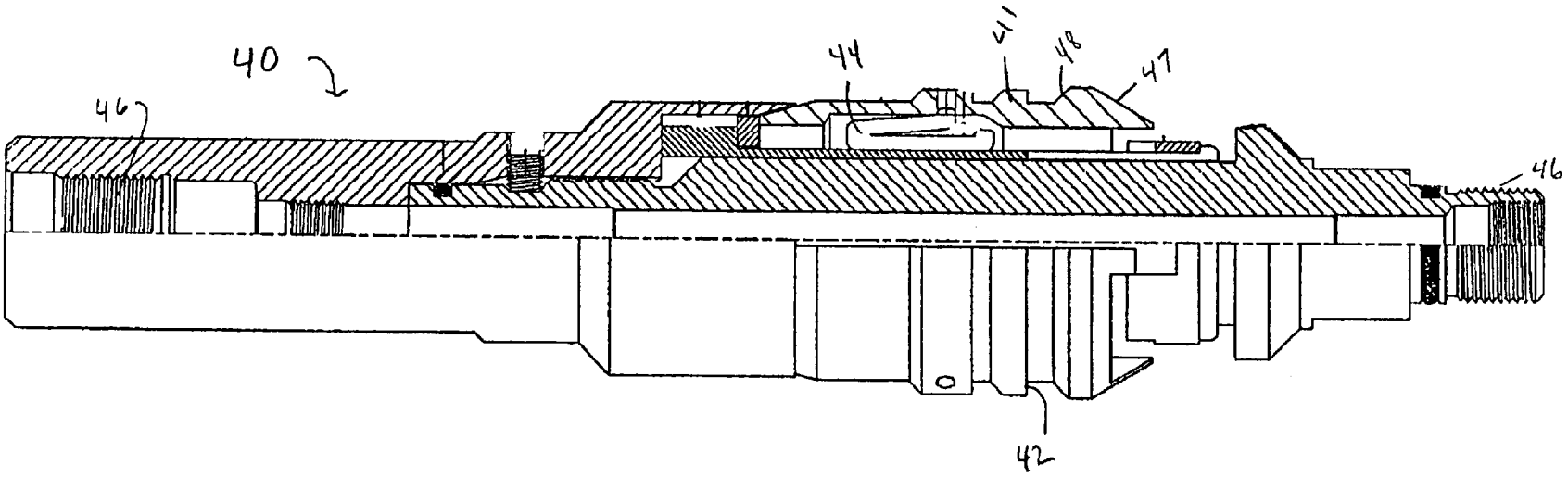
FIG. 2 illustrates a cross section of one embodiment of a cutting tool locator.

In FIG. 2 specific details of one embodiment of the present invention are illustrated. Here the locator shoulder 42 is formed onto a shifting key 41. The shifting key 41 comprises at least two pieces attached to the body of the cutting tool locator 40 that are urged away from the body by a locator shoulder spring 44. Threads 46 are formed on the bottom of the cutting tool locator 40 for attachment to the cutting tool 50. Other forms of attachment can be used to attach the cutting tool 50 to the cutting tool locator 40 as well, including but not limited to welding, bolting, and set screws. The top of the cutting tool locator 40 also has threads 46 for attachment to a wireline 20, however the form of attachment here is not critical and any now known or later developed ways of wireline attachment could be used.

In operation, the cutting tool locator 40 of FIG. 2 is attached to the cutting tool 50 on its lower end and a wireline 30 on its upper end. The cutting tool 50 and cutting tool locator 40 are then lowered into the production string 20 and wellbore 10 until the lower ledge 47 contacts the detent 32. The spring force of the locator shoulder spring 44 should be of a magnitude such that when the lower ledge 47 contacts the detent, the gravitational force upon the cutting tool locator 40 and cutting tool 50 alone is sufficient to urge the shifting key 41 inward. As the cutting tool locator 40 slides past the detent 32 the spring 44 maintains the shifting key 41 in contact with the detent 32 and forced the locator shoulder 42 into contact with the detent 32. As long as the locator shoulder 42 is pushed outward by the spring 44 and is able to contact the detent 32, the locator shoulder 42 will prevent the cutting tool locator 40 from proceeding downward within the production string 20 past the detent 32. Additionally, while the shifting key 41 is moveable radially with respect to the cutting tool locator 40, it should not be able to move in an axial direction.

Since the cutting tool 50 is fixed a certain distance below the locator shoulder 42, placement of the detent 32 dictates where the cutting tool 50 will be located within the production string 20. Furthermore, and more importantly, placement of the detent 32 determines where the cutting tool 50 can sever the production string 20. Thus proper placement of the detent 32 within the production string 20, in light of the distance between the cutting flame 52 and the locator shoulder 42, enables precision cuts within a production string 20—even when using a wireline 30. Accordingly, it is important that care be used in determining the position of the detent 32.

After the cutting tool locator 40 is positioned on the detent 32, the cutting tool 50 can be activated to initiate the cutting sequence and sever the production string 20. When the cutting sequence is complete, the wireline 30 can be pulled upward to remove the cutting tool locator 40 from the wellbore 10. When the cutting tool locator 40 is lowered into the production string 20, the angle formed by the outer radius of the lower ledge 47 results in a force applied by the detent 32 that pushes the shifting key 41 inward and enables the cutting tool locator 40 to be easily passed across the detent 32. Likewise, the angle of the outer radius of the upper ledge allows the detent 32 to push the shifting key 41 inward when the cutting tool locator 40 is raised up from the production string 20. One of the many novel features of the present invention allows not only for the initial precision cutting sequence in a production string 20, but all subsequent cutting sequences can be performed at the exact same location within the production string 20. This is important when more than one cutting sequence is required to fully sever the production string 20; the production string 20 cannot be severed if a subsequent cutting sequence does not cut at substantially the same location as a previous cut. Thus one of the many advantages of the present invention is that it guarantees that all cutting sequences can be performed at the same location within the production string 20.

The proximity of the locator shoulder 41 to the upper ledge 48 provide for a lock around the detent 32 that helps to axially secure the cutting tool locator 40 during the cutting sequence. Since the cutting tool 50 is directly fastened to the cutting tool locator 40, the locking function of the upper ledge 48 and the locator shoulder 41 work to ensure that the cutting tool 50 produces a steady and even cut into the production string during the cutting sequence.

Figure 3:
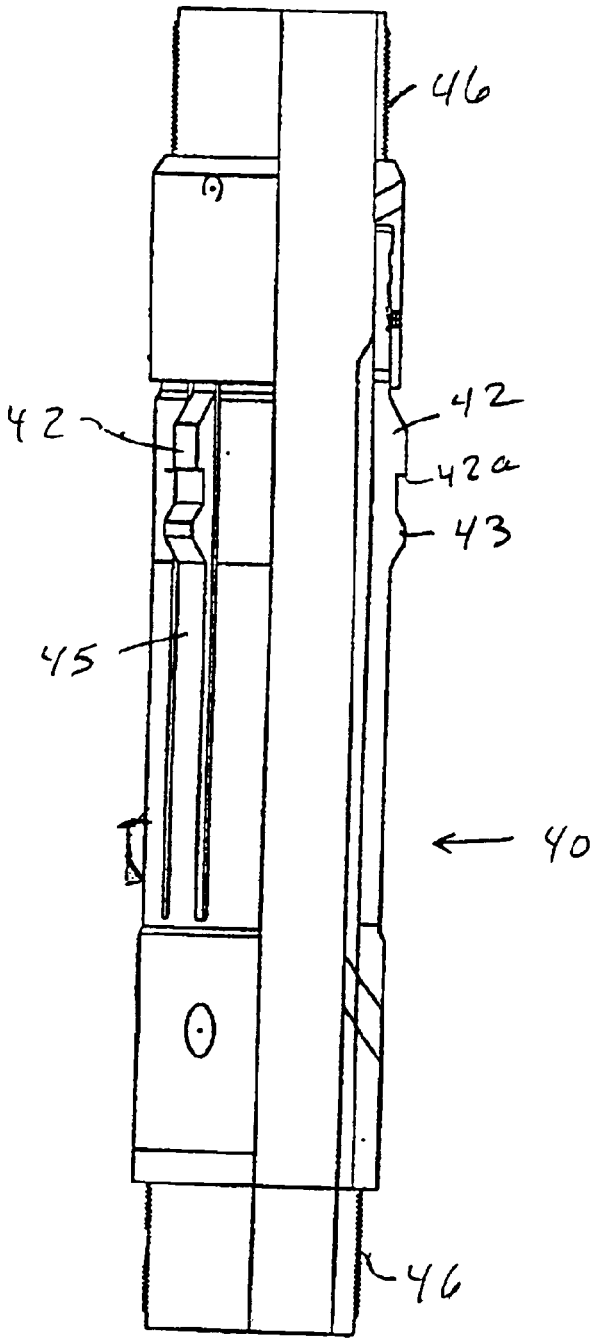
FIG. 3 illustrates on example of an alternative embodiment of a cutting tool locator.

In FIG. 3 an alternative embodiment of the cutting tool locator 40 is provided. The operation of this alternative embodiment is much the same as already described. Threads 46 provided on the upper ends allow for connection to a wireline 30 and a cutting tool 50 on its lower end. Formed onto the locator shoulder 42 is a ledge 42*a* that provides a stopping action when the locator shoulder 42 contacts a detent 32. However, this alternative embodiment provides the additional function of selectivity in the event multiple detents 32 are formed onto the production string 20, but it is determined that the cutting tool locator 40 contact a single specific detent 32. For purposes of this disclosure, the specific detent 32 is the detent 32 upon which the locator shoulder 42 must rest in order to sever the production string 20 at the proper location. Generally the specific detent is the detent 32 just above the production string failure. As such, if the cutting tool locator 40 couples with the specific detent 32 the cutting tool 50 will then be positioned to sever the production string at the proper location so the damaged portion of the production string can be removed and replaced.

The selectivity function of this alternative embodiment is accomplished by retaining the locator shoulder 42 inward such that its outer diameter is less than the inner diameter of the detents 32. Included with the alternative embodiment is a frangible selector latch (not shown) that extends downward from the cutting tool locator 40 or cutting tool 50. When the locator shoulder 42 is proximate to the specific detent 32 the cutting tool locator 40 is raised upward within the wellbore 10 and the selector latch snags onto a profile within the pipe string and fractures per design. When the selector latch fractures it releases the retaining force that retains the locator shoulder 42 inward thus allowing the locator shoulder 42 outward into engaging contact with the specific detent 32. The concept of a selector latch is well known in the art and can be produced by one skilled in the art without undue experimentation.

After the selector latch is fractured the cutting tool locator 40 is then re-lowered back to the specific detent 32 so that the now released locator shoulder 42 can contact the specific detent 32, whereupon the cutting tool locator 40 rests on and is supported by the specific detent 32. When the cutting tool locator 40 is seated onto the specific detent 32 the cutting tool 50 can be activated to sever the production string 20 at exactly the desired location within the wellbore, for single or multiple cuts. Selective placement of the cutting tool locator 40 enables it to be positioned at the specific detent 32 and travel past detents 32 that are not associated with production string failures.

The present invention described herein, therefore, is well adapted to carry out the objects and attain the ends and advantages mentioned, as well as others inherent therein. While a presently preferred embodiment of the invention has been given for purposes of disclosure, numerous changes in the details of procedures for accomplishing the desired results. Such as, the wireline 30 can be comprised of a traditional wireline, a slickline, pipe conveyed, coiled tubing, or any other suitable manner of lowering and raising the cutting tool locator 40 with cutting tool 50 in and out of the wellbore 10. These and other similar modifications will readily suggest themselves to those skilled in the art, and are intended to be encompassed within the spirit of the present invention disclosed herein and the scope of the appended claims.

What is claimed is:

1. A locator system for use in a production string having at least two detents along its circumference, said locator system comprising:

a lock formed to selectively engage a specific detent;

a cutting device; and a body on which said lock is attached, where said body is connected to the cutting device such that when said lock is engaged to the detent, said cutting device is operatively connected to the detent and the cutting device is positioned at a location to accurately sever the production string at a desired depth.

2. The locator system for a cutting device of claim 1, where at least one of the detents is a nipple profile.

3. The locator system for a cutting device of claim 1 where the production string comprises a series of tubing members connected end to end.

4. The locator system for a cutting device of claim 1, where the production string comprises at least one tubing member in combination with at least one completion tool.

5. The locator system for a cutting device of claim 3, where the completion tool is a packer.

6. The locator system for a cutting device of claim 1, where said lock comprises at least one member disposed on said body configured to engage the detent.

7. The locator system for a cutting device of claim 6 further comprising at least one spring urging said at least one member into engaging contact with the detent.

8. The member of claim 6 having an outer surface formed to fixedly mount upon said detent thereby supporting said placement system for a cutting device within said production string such that said cutting device is positioned at a location within the production string to sever the production string at a desired location.

9. The placement system for a cutting device of claim 1 further comprising a means for inserting said system within a wellbore selected from the group consisting of a wireline, a slickline, pipe conveyed, and coiled tubing.

10. A method of positioning a cutting device to cut a tubular member disposed within a wellbore comprising:

forming at least two detents on the tubular member;

securedly disposing the tubular member within a wellbore;

forming a lock on the cutting device to engage a detent;

identifying a specific detent to be engaged by said lock;

inserting the cutting device within the wellbore; and selectively engaging said lock with said specific detent to be engaged by said lock such that the cutting device is positioned to cut the tubular member at the location where it is desired to cut the tubular member.

11. The method of positioning a cutting device to cut a tubular member disposed within a wellbore of claim 10 where said lock is formed on the cutting device such that said cutting device can repeatedly be inserted in said wellbore and cut the tubular member at the same location as any previous cut.

12. The method of positioning a cutting device to cut a tubular member disposed within a wellbore of claim 10 further comprising forming said at least one detent into a nipple profile.

13. The method of positioning a cutting device to cut a tubular member disposed within a wellbore of claim 10 further comprising forming the production string by connecting a series of tubing members end to end.

14. The method of positioning a cutting device to cut a tubular member disposed within a wellbore of claim 10 further comprising forming the production string from at least one tubing member in combination with at least one completion tool.

15. The method of positioning a cutting device to cut a tubular member disposed within a wellbore of claim 14 where the completion tool is a packer.

16. The method of positioning a cutting device to cut a tubular member disposed within a wellbore of claim 10 further comprising forming said lock to comprise at least one member disposed on said body configured to engage the specific detent.

17. The method of positioning a cutting device to cut a tubular member disposed within a wellbore of claim 10 further comprising including at least one spring urging said at least one member into engaging contact with the specific detent.

18. The method of positioning a cutting device to cut a tubular member disposed within a wellbore of claim 10 further comprising inserting said cutting device within the wellbore with a lowering means selected from the group consisting of a wireline, a slickline, pipe conveyed, and coiled tubing.

* * * * *